US005582406A

United States Patent [19]

Babcock

[11] Patent Number: 5,582,406

[45] Date of Patent: Dec. 10, 1996

[54] HOCKEY STICK BLADE COUPLER

[76] Inventor: Martin Babcock, 2214 Tower Ct., Woodbury, Minn. 55125

[21] Appl. No.: 529,678

[22] Filed: Sep. 18, 1995

[51] Int. Cl.[6] ..... A63B 59/14

[52] U.S. Cl. ..... 273/67 A; 473/307

[58] Field of Search ..... 273/67 A, 735, 273/80.1; 473/307

[56] References Cited

U.S. PATENT DOCUMENTS

| | | | |
|---|---|---|---|
| 1,438,030 | 12/1922 | Hall | 273/67 A |
| 3,961,790 | 6/1976 | Milligan | 273/67 A |

FOREIGN PATENT DOCUMENTS

| | | | |
|---|---|---|---|
| 633295 | 12/1961 | Canada | 273/67 A |
| 2060962 | 8/1992 | Canada | 273/67 A |
| 3012300 | 10/1981 | Germany | 273/67 A |

*Primary Examiner*—Mark S. Graham
*Attorney, Agent, or Firm*—D. L. Tschida

[57] ABSTRACT

A tapered wedge for coupling a hollow tubular hockey stick handle to a solid blade. A tapered surface of a multi-surface, wedge is shaped to mate to a complimentary surface of a mounting tang at the stick. A threaded screw follower is fitted to the wedge and is accessible at a slot in the blade. Threads at the follower mate to a bore at the blade and upon rotating the screw follower, the wedge and tang are drawn into compression with the handle.

10 Claims, 3 Drawing Sheets

HOCKEY STICK BLADE COUPLER

BACKGROUND OF THE INVENTION

The present invention relates to multi-section hockey sticks and, in particular, to a drawn coupler for retaining a stick to a tubular handle.

Historically, playing sticks such as used in ice or street hockey and other sports have been constructed as one-piece, integral sticks. The sticks are typically constructed of a solid handle and a laminated wooden blade. Fiberglass, KEVLAR, and other fiber materials are frequently applied as covering layers or at laminant layers to add rigidity and enhance the tensile properties of the sticks. However, with any damage to the stick, such as cracks, chips or breaks, the entire stick must be discarded and replaced with a new stick.

With the advent and availability of numerous materials of high tensile strength and flexibility, efforts have been extended to develop multi-section sticks. Such sticks typically provide a hollow handle and to which a separate blade is secured. The handle may be constructed of various high tensile strength materials, such as fiberglass, aluminum, and various other metal and plastic composites. The blades, in turn, are constructed in traditional fashion of wood laminates or glass covered wood.

A tang piece typically projects from a heel portion of the blade and is formed to a cross sectional shape complementary to the bore of the handle. The blade is typically retained to the handle with the application of an adhesive to the tang. A variety of thermal resins are frequently used to this end.

U.S. Pats. Nos. 3,638,942 and 3,934,875 disclose sectional and molded hockey sticks using various mechanical fasteners between the blade and handle. U.S. Pats. No. 3,934,875 discloses a splinted coupler.

U.S. Pats. Nos. 4,570,932 and 5,261,662 respectively disclose a blade that includes a wedge and a stick having a handle splinted to the blade.

The present coupler assembly was developed to overcome shortcomings of prior sticks and particularly to obtain a coupler which optimizes the surface contact between the handle and blade without permitting voids or gaps conducive to possible fracture of the handle or blade at the coupler. A tapered wedge including a drawn screw follower that is accessible through the handle and or blade was particularly developed.

SUMMARY OF THE INVENTION

It is accordingly a primary object of the invention to provide a wedged coupler for retaining a playing blade of a sporting stick to a hollow tubular handle section.

It is a further object of the invention to provide a wedged coupler which cooperates with a tang at the blade such that one can be externally manipulated relative to the other to provide a detachable, compressive coupling which expands and contracts internally of a bore at the handle.

It is a further object of the invention to provide a wedge having a tapered slide surface which cooperates with a tapered slide surface at the tang in relation to rotation of a screw follower that is supported to the wedge and threaded to the tang to provide a compressive fastening to the handle.

It is a further object of the invention to provide a wedged coupler having a captured screw follower which is accessible through a bore at the blade and having a threaded surface which mates to the blade.

It is a further object of the invention to provide a wedge fitted to two surfaces at the blade and having a shouldered surface that cooperates with the screw follower.

Various of the foregoing objects, advantages and distinctions of the invention are obtained in alternatively disclosed constructions. In a presently preferred construction, a drawn, tapered wedge is shaped to abut three of four surfaces at a hollow handle. A screw follower member is supported at a longitudinal bore of the wedge and provides a flanged head that cooperates with the wedge to extend and extract the wedge in relation to rotational movement imparted to the follower from a fastener tool. A threaded self-tapping surface at the follower fastens to a bore at the blade, where the tool is inserted, and draws the wedge into compression with the handle.

In an alternative construction, a wedge is provided having two surfaces which mate to the handle. A shoulder which projects transverse to a tapered slide surface mates with a flanged portion of the wedge. A flanged head of the follower cooperates with the shoulder.

The foregoing and still other objects, advantages and distinctions are more apparent from the following description with respect to the appended drawings. To the extent various modifications and improvements have been considered, they are described as appropriate. The descriptions, however, should not be literally construed in limitation of the invention, which rather should be interpreted within the broad scope of the further appended claims.

DESCRIPTION OF THE PREFERRED EMBODIMENTS

Figure 1:
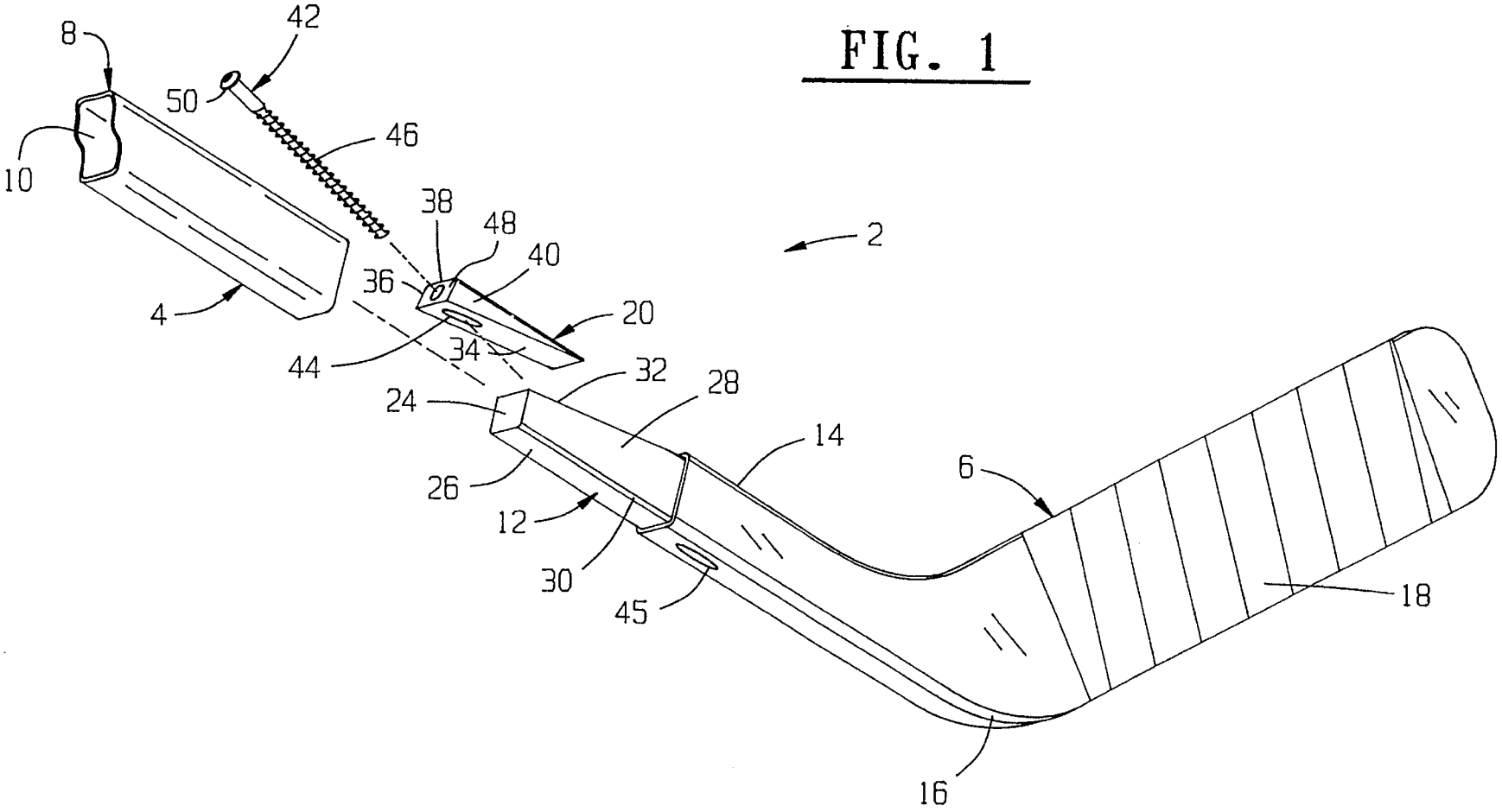
FIG. 1 is a perspective drawing is shown in exploded assembly to a three surface wedge coupler.

With attention to FIG. 1, a perspective drawing is shown in exploded assembly to the wedged coupler 2 of the invention. The coupler 2 retains a tubular handle 4 to a replaceable blade 6 of a hockey stick 8. Depending upon the type of stick and player, the handle 4 extends an appropriate length between the blade 6 and a hand hold region (not shown) of the handle 4. A hollow bore 10 at the handle 4 receives a shaped mounting tang 12 of the blade 6. The tang 12 is recessed from a head portion 14 of the blade a suitable distance to accommodate the wall thickness of the handle 4.

Stick assemblies of the foregoing type have recently become popular for a variety of stick based sports. For example, blades are frequently used for the sports of ice hockey and roller hockey. Depending upon the sport, however, different characteristics are required for proper play. The stick 8 provides a player the flexibility to select a handle constructed of a preferred material and to change blades as they break or as the player's preference changes. A player thus has the option of not having to buy a new stick each time a blade breaks and can now buy only the desired stick part he or she requires.

The quality of the handle 4 as well as the quality and shape of the blade 6 can similarly be varied. The handle 4 can be constructed from a variety of materials, such as aluminum, graphite, fiberglass, and various metal and glass composites, among a number of high tensile strength alloys and composites.

The blade 6 can be similarly constructed from a variety of materials, such as wood, glass covered wood, laminates and plastics, among a number of other composite materials. The shape and construction of the heel 16, head 14 and playing surface 18 of the blade 6 can be suitably varied to complement the sport. For example, right and left hand curvatures of varying degrees can be shaped into the playing surface 18 to accommodate a particular sport.

The coupler between the handle 4 and blade 6 occurs at the mounting tang 12 and a wedged coupler 20. The tang 12 is shaped to provide a number of flat surfaces 24, 26 and 28 and chamfered edges 30 of complimentary shape to the bore 10 at the handle 4. A tapered longitudinal surface 32 of the tang 12 cuts across the end profile of the handle 4.

The wedged coupler 20 provides a complimentary tapered surface 34 and a number of sidewall surfaces 36, 38 and 40. Upon fitting the tapered surfaces 34 and 32 of the wedge 20 and tang 12 to one another, a cross sectional shape is presented that corresponds to the bore 10.

Figure 2:
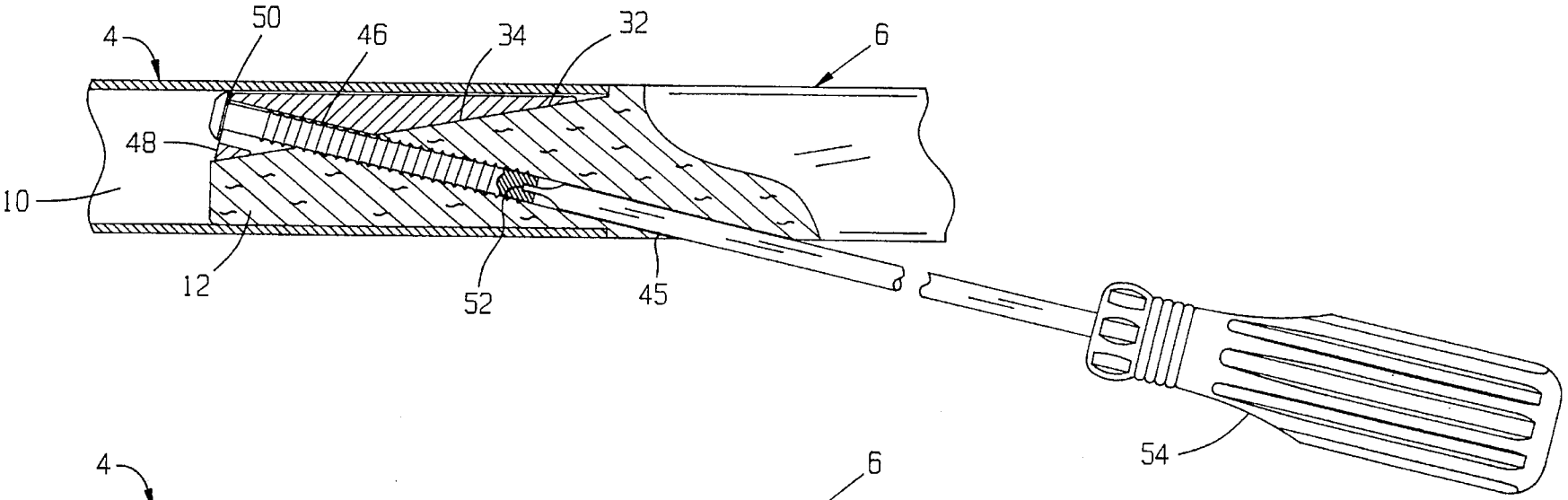
FIG. 2 is a partial cross section view through the wedge and handle prior to drawing the wedge tight to the handle.
Figure 3:
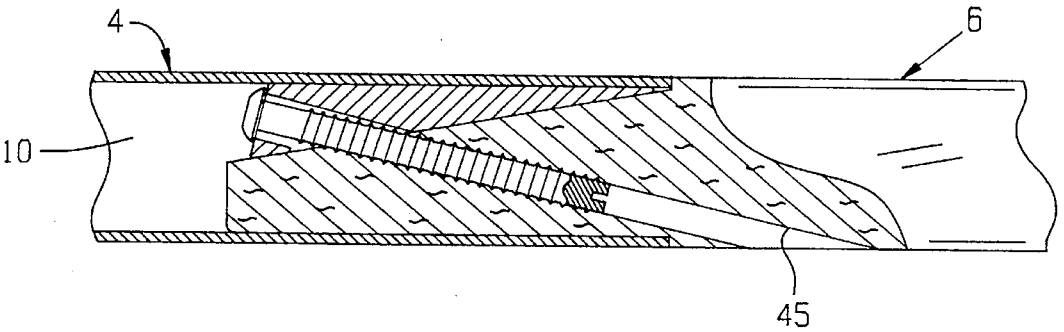
FIG. 3 is a cross section view showing the wedge in a tightened condition.

Supported to the wedge 20 is a screw follower 42 which provides a mechanism for obtaining a longitudinal slide action at the wedge 20 to extend and retract the wedge 20 and the surfaces 24–28 and 36–40 into and out of compression with the interior walls of the bore 10. FIGS. 2 and 3 depict alternative released and compressed conditions of the wedge 20 from the handle 4.

A bore 44 at the wedge 20 contains a screw follower 42 and the follower 42 extends into a bore 45 at the tang 12. Self tapping threads 46 at the follower 42 couple with the bore 45 to impart longitudinal movement to the wedge 20. Depending upon the blade construction, threads can be provided at the bore 45 or a threaded insert can be fitted to the bore 45.

Presently the follower 42 does not interact with the bore 44. The bore 44 may however include a threaded surface or a threaded insert which cooperates with threads 46 of the screw follower 42.

A shoulder 48 at the wedge 20 cooperates with a head 50 of the screw follower 42 such that upon rotating the screw follower 42 in one direction, the follower 42 pulls the wedge 20 toward the heel 16 and into compression with the handle 4. Upon rotating the follower 42 in an opposite direction, the wedge 20 is released and the blade 6 can be removed from the handle 4.

Once compressed, all surfaces of the handle 4 and tang 12 are closely bound and all vibrations or rotation at the tang 12 are prevented. Suitable thread locking materials can be applied to the follower threads 46 to prevent any loosening of the follower 42 over time and use.

The wedge 20 and follower 42 can be constructed from a variety of materials. Presently, the wedge 20 is formed of a die cast zinc and the follower 42 from a mild, case hardened steel. A variety of other metals and plastics compatible to the handle 4 and blade 6 can be substituted. The follower 42 may also be captured to the wedge 20 with the positioning of appropriate crimps or retainers, such as washers with reduced size, slotted apertures, at the follower 42 or the wedge 20 to prevent release from one another.

Figure 4:
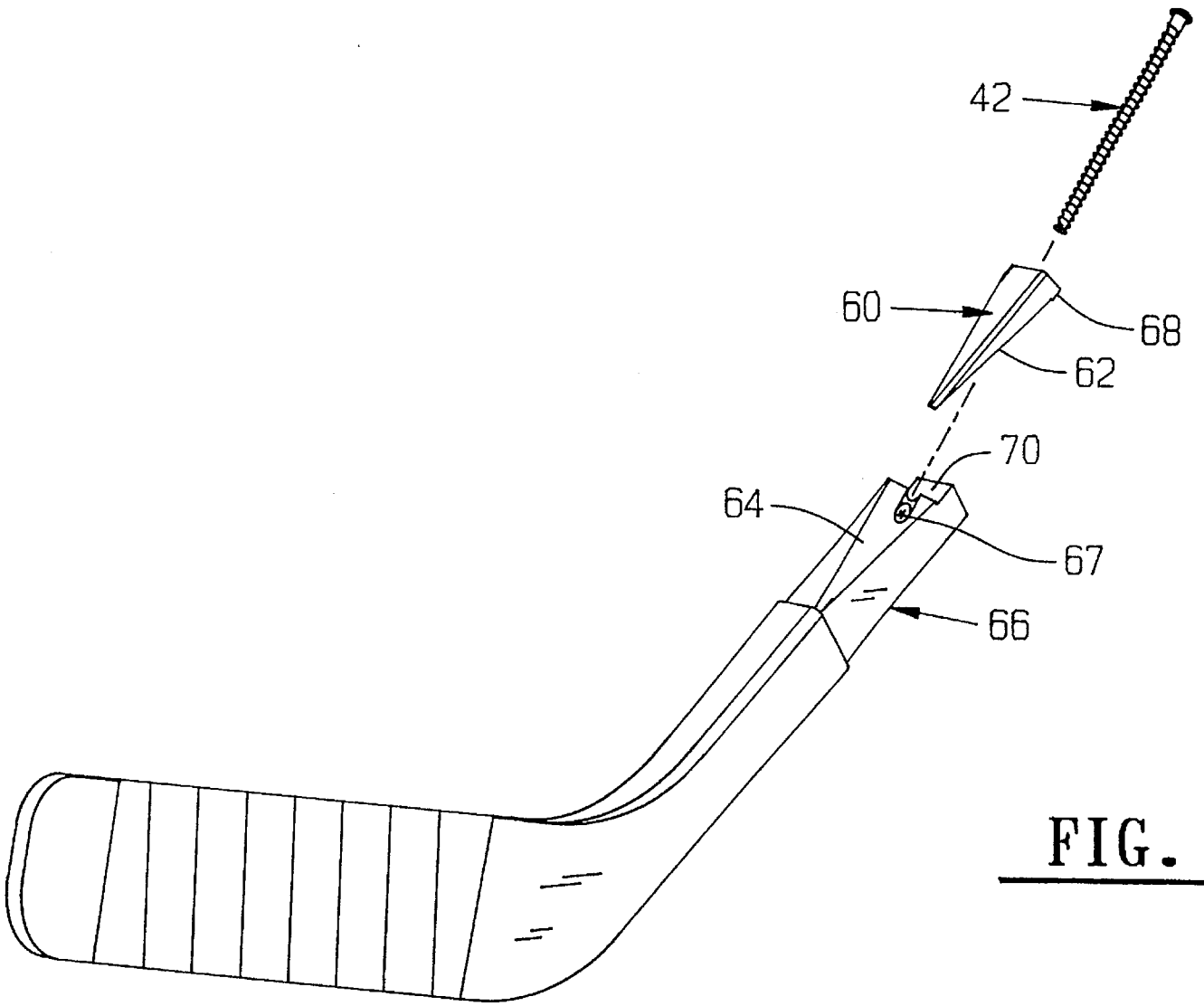
FIG. 4 is a perspective drawing showing in exploded assembly to a two surface wedge.

A slot 52 is presently cut into the end of the follower 42 which cooperates with a screw driver 54, reference FIG. 3, that is inserted into the bore 45 of the tang 12. A recess may alternatively be formed into the end of the follower 42 to receive a torx wrench or Allen key.

Where the wedge 20 mates with three surfaces of the handle 4, FIG. 4 depicts a wedged coupler 60 which mates with two surfaces of a handle (not shown). Complementary tapered surfaces 62 and 64 at the wedge 60 and tang 66 align with and slide along one another as the screw follower 42 is extended and retracted at threaded surfaces 67 within the tang 66 and wedge 60. Overlapping transverse shoulders 68 and 70 are provided at the wedge 60 and tang 66 to provide sufficient surface area and mechanical support for the flanged head 50.

While the invention has been described with respect to considered alternative embodiments, still other constructions may be suggested to those skilled in the art. The invention should therefore be interpreted to include all those embodiments within the spirit and scope of the following claims.

What is claimed is:

1. A hockey stick comprising:

a) a handle having a hollow bore;

b) a wedge having an end wall from which a plurality of longitudinal sidewalls extend, a tapered longitudinal surface which tapers outward to at least two of said sidewalls, and a bore opening to said tapered surface and to said end wall;

c) a replaceable blade having a mounting tang including a plurality of longitudinal sidewalls and a tapered longitudinal surface, wherein upon mating the tapered surface of said wedge to the tapered surface of said tang said wedge and tang collectively exhibit a cross sectional shape corresponding to the bore of said handle, and wherein a bore extends through said tang coaxial to the bore of said wedge to an exposed surface of said blade; and d) screw means having a flange which abuts the end wall of said wedge and a threaded shank which mates to the bore of said tang, whereby upon rotating said screw means said wedge longitudinally extends and retracts along said tang to induce the sidewalls of said tang and wedge to grip or release the bore of said handle.

2. A replaceable head piece for a handle having a hollow bore comprising:

a) a wedge having an end wall from which a plurality of longitudinal sidewalls extend, a tapered longitudinal surface which tapers outward and includes edges which intersect at least two of said sidewalls, and a bore opening to said tapered surface and to said end wall;

b) a blade having a mounting tang including a plurality of longitudinal sidewalls and a tapered longitudinal surface, wherein upon mating the tapered surface of said wedge to the tapered surface of said tang said wedge and tang collectively exhibit a cross sectional shape corresponding to the bore of said handle, and wherein a bore extends through the tapered surface of said tang coaxial to the bore of said wedge to an exposed surface of said blade; and c) screw means having a flange which abuts the end wall of said wedge and a threaded shank which mates to the bore of said tang, whereby upon rotating said screw means said wedge longitudinally extends and retracts along said tang such that the sidewalls of said tang and wedge can grip or release the bore of said handle.

3. A replaceable head piece for a handle having a hollow bore comprising:

a) a wedge having an end wall from which a plurality of longitudinal sidewalls extend, a tapered longitudinal surface which tapers outward to at least two of said sidewalls, and a bore opening to said tapered surface and to said end wall;

b) a hockey blade having a mounting tang including a plurality of longitudinal sidewalls and a tapered longitudinal surface, wherein upon mating the tapered surface of said wedge to the tapered surface of said tang said wedge and tang collectively exhibit a cross sectional shape corresponding to the bore of said handle, and wherein a bore extends through the tapered surface of said tang coaxial to the bore of said wedge; and c) screw means having a flange which contains said wedge to said screw means and a threaded shank which mates to the bore of said tang, whereby upon rotating said screw means said wedge longitudinally extends and retracts along said tang such that the sidewalls of said tang and wedge can grip or release the bore of said handle.

4. Apparatus as set forth in claim 3 wherein the bore of said tang is threaded.

5. Apparatus as set forth in claim 3 wherein said shank of said screw means includes a slotted end which mates with a screwdriver.

6. Apparatus as set forth in claim 3 wherein the tapered surface of said wedge extends along adjoining first, second and third sidewalls.

7. Apparatus as set forth in claim 3 wherein the tapered surface of said wedge extends along adjoining first and second sidewalls.

8. Apparatus as set forth in claim 3 wherein said wedge and said tang include overlapping flanged surfaces which project from the respective tapered surfaces of said tang and said wedge.

9. Apparatus as set forth in claim 3 wherein the bore of said handle exhibits a rectangular cross sectional shape.

10. Apparatus as set forth in claim 3 including means for retaining said screw means to said wedge.

* * * * *